United States Patent [19]

Braun et al.

[11] 4,128,115

[45] Dec. 5, 1978

[54] ENTRAINING ELEMENT FOR A GRIPPER SHUTTLE

[75] Inventors: Rudolf Braun, Winterthur, Switzerland; Werner Kellmann, Allensbach, Germany

[73] Assignee: Sulzer Brothers Limited, Winterthur, Switzerland

[21] Appl. No.: 873,778

[22] Filed: Jan. 31, 1978

[30] Foreign Application Priority Data

Feb. 4, 1977 [CH] Switzerland ..... 1352/77

[51] Int. Cl.[2] ..... D03D 47/24

[52] U.S. Cl. ..... 139/439; 198/730; 198/733

[58] Field of Search ..... 139/436, 439; 198/725, 198/727, 728, 730 X, 731, 733 X

[56] References Cited

U.S. PATENT DOCUMENTS 3,559,796 2/1971 Marks et al. ..... 198/731

3,982,567 9/1976 Pfavrwaller ..... 139/439

FOREIGN PATENT DOCUMENTS 2434083 1/1976 Fed. Rep. of Germany ..... 139/439

563478 6/1975 Switzerland ..... 139/439

*Primary Examiner*—Henry S. Jaudon

*Attorney, Agent, or Firm*—Kenyon & Kenyon, Reilly, Carr & Chapin

[57] ABSTRACT

The entraining element is constructed of a carrier, a striking member and a support member. The striking member is fixed to the conveyor chain via the carrier and has a resilient striking plate which extends transversely of the gripper shuttle path for returning a shuttle to the picker. The support member is mounted behind the striking plate to define a gap with the striking plate in the unloaded state. Upon deflection of the striking plate during loading, the plate abuts resiliently against the support member.

13 Claims, 7 Drawing Figures

ENTRAINING ELEMENT FOR A GRIPPER SHUTTLE

This invention relates to an entraining element for a gripper shuttle. More particularly, this invention relates to an entraining element for mounting on a return chain of a gripper shuttle weaving machine.

As is known, various types of weaving machines or looms employ gripper shuttles which are picked through a shed from a picker to a catcher and returned from the catcher to the picker via a conveyor. In some cases, the conveyor has been in the form of a conveyor chain provided with projecting entraining elements which abut the gripper shuttles in order to convey the shuttles back to the picker. These entraining elements have been constructed in various manners. For example, as described in U.S. Pat. No. 3,765,458, one such entraining element is made of plastic and is spring biased into engagement over a pair of plates or webs of the conveyor chain and is secured to the chain via recesses which are shaped to the contour of the chain plates. However, retention of these entraining elements on the conveyor chain has been unsatisfactory. As a practical matter, these entraining elements have often detached from the chain during operation.

Another type of entraining element is described in Swiss Pat. No. 563,478. This entraining element is formed with a plastic member which is used as a striking member while an angled part of a plate serves as a core with the plastic member extruded around the angled part. However, entraining elements of this type have been found to wear at a relatively rapid rate even when abrasion-resistent plastics are used. This is due to the continuous striking stress in the striking zone.

Accordingly, it is an object of the invention to provide an entraining element which cannot be easily detached from a conveyor chain.

It is another object of the invention to provide an entraining element which has a relatively long operating life.

It is another object of the invention to provide an entraining element for a gripper shuttle which is of relatively simple construction.

It is another object of the invention to reduce the downtime of a weaving machine due to faults caused in the return gripper shuttles to a picker.

Briefly, the invention provides an entraining element which comprises a carrier, a striking member mounted on the carrier and which includes a resilient striking plate with a striking surface extending transversely to a gripper shuttle path and a support member which is mounted within the striking member behind the striking plate to define a gap therebetween. When a gripper shuttle is struck, the striking plate is able to deflect resiliently and to resiliently abut against the support member.

The carrier is constructed, for example, of a pair of sheet metal plates so as to be mounted on opposite sides of a return conveyor chain of a gripper shuttle weaving machine.

The striking member is mounted on the carrier so as to extend into the return path of the gripper shuttles. To this end, one of the carrier plates may be integrally formed with the striking member.

The support member is provided with a pair of parallel ribs which extend longitudinally of the support member in alignment with the striking plate. The ends of the ribs serve as abutments against which the resilient striking plate abuts when deflected. The innermost one of these ribs also serves as a guide for movement along a guide wall of a guide channel for the gripper shuttles.

The conveyor chain which is disposed alongside a return path of the gripper shuttle includes chain pins which secure the carrier and the support member to the chain.

These and other objects and advantages of the invention will become more apparent from the following detailed description taken in conjunction with the accompanying drawings in which.

Figure 1:
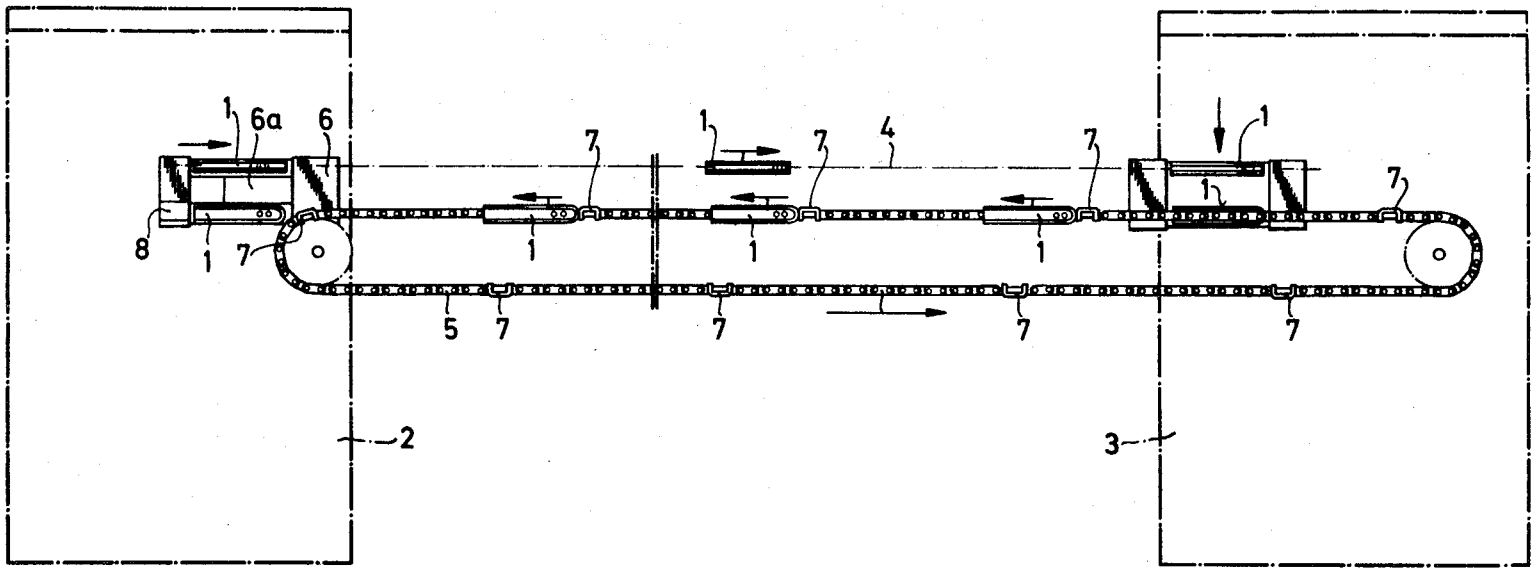
FIG. 1 illustrates a diagrammatic view of a gripper shuttle weaving machine employing an entraining element in accordance with the invention.

Referring to FIG. 1, a weaving machine of the gripper shuttle type is provided with a picker 2 which serves to pick a series of gripper shuttles 1 along a flight path 4 to a catcher 3. In addition, the weaving machine has a return conveyor chain 5 which returns the shuttles 1 from the catcher 3 to the picker 2 as is known. Before entering the picker 2, each projectile 1 is centered by a lock 6 which also serves as a bearing for the rotatably mounted shuttle lift 6*a*, and is pushed farther by an entraining element 7 on the chain 5 into the lift 6*a* until abutting against an abutment 8. The entraining element 7 thus serves to locate a shuttle 1 in the picker 2.

Referring to FIGS. 2 to 7, each entraining element 7 is constructed with a carrier 20, a striking member 22 and a support member 36.

Figure 2:
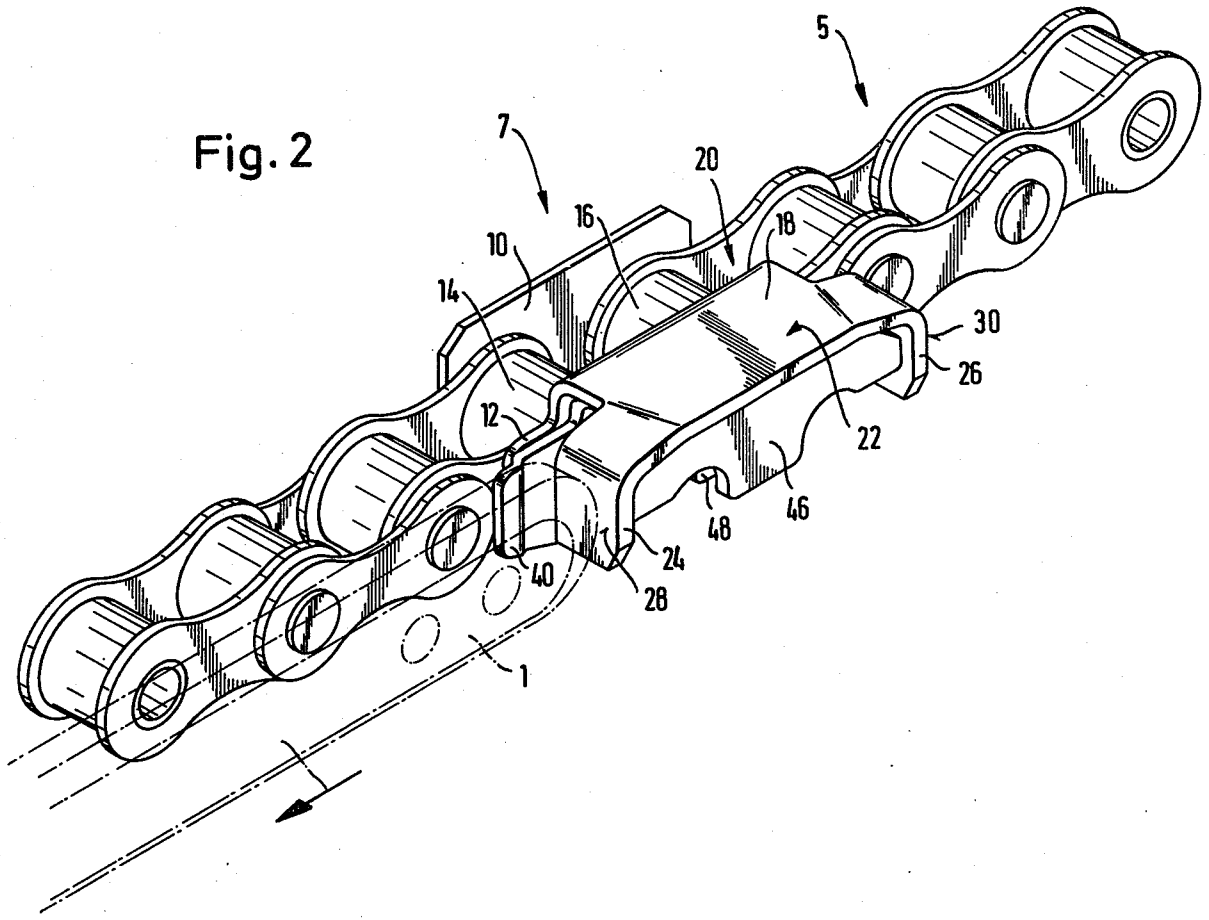
FIG. 2 illustrates a perspective view of an entraining element according to the invention on a return chain.
Figure 3:
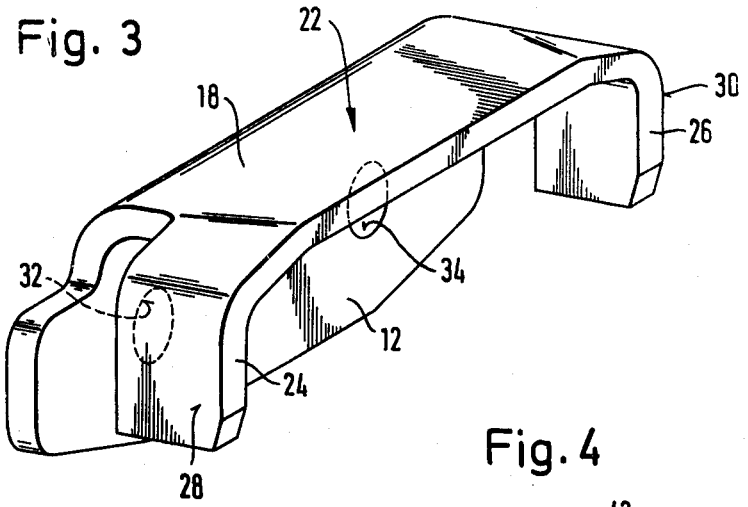
FIG. 3 illustrates a perspective view of a striking member of an entraining element integrated with a carrier according to the invention.

Referring to FIG. 2, the carrier 20 is formed of a pair of plates 10, 12, for example of sheet metal, which are mounted on opposite sides of the chain 5 via chain pins 14, 16. As shown in FIG. 3, the plate 12 has a pair of apertures 32, 34 which receive the chain pins 14, 16.

Referring to FIG. 3, the plate 12 of the carrier 20 is integrally formed with an angled part 18 which carries the striking member 22 thereon. As shown, the striking member 22 includes a pair of striking plates 24, 26 which extend transversely of the path of a shuttle (not shown) and each has a shuttle-striking surface 28, 30. As shown in FIG. 2, the forwardmost striking plate 24 serves to strike a shuttle 1 while the rearmost striking plate 26 prevents the shuttle 1 from being knocked by a following shuttle, for example as a result of jerky movements of the chain 5. In practical operation, the striking stresses on the two striking plates 24, 26 may be substantially the same.

Figure 4:
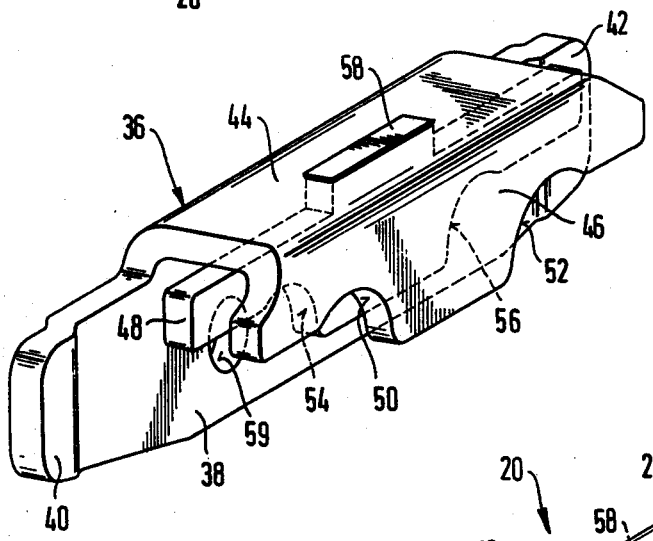
FIG. 4 illustrates a perspective view of a support member in accordance with the invention.

Referring to FIG. 4, the support member 36 is formed with a plate or web 38 having two projections 40, 42 at the longitudinal ends. These projections 40, 42 correspond substantially to the height of the rivet heads of the chain pins 14, 16 and form a guide surface for a guide wall or band 64 (FIG. 7) of a shuttle guide channel 66 in the plane of the rivet head. The web 38 is connected to an angled part 44 having a pair of ribs 46, 48 which extend longitudinally in parallel relation to the chain 5. Each of these ribs 46, 48 is formed with semicircular recesses 50, 52; 54, 56 in order to facilitate riveting of the support member 36 to the chain pins 14, 16 (FIG. 5) ofthe chain 5. The web 38 is also provided with a pair of apertures 59, only one of which is shown, in order to permit passage of the chain pins 14, 16. As shown, the outer rib 46 of the support member 36 forms a continuation of the angled part 44 while the inner rib 48 is riveted to the angled part 44 by way of a rectangular projection 58.

Figure 5:
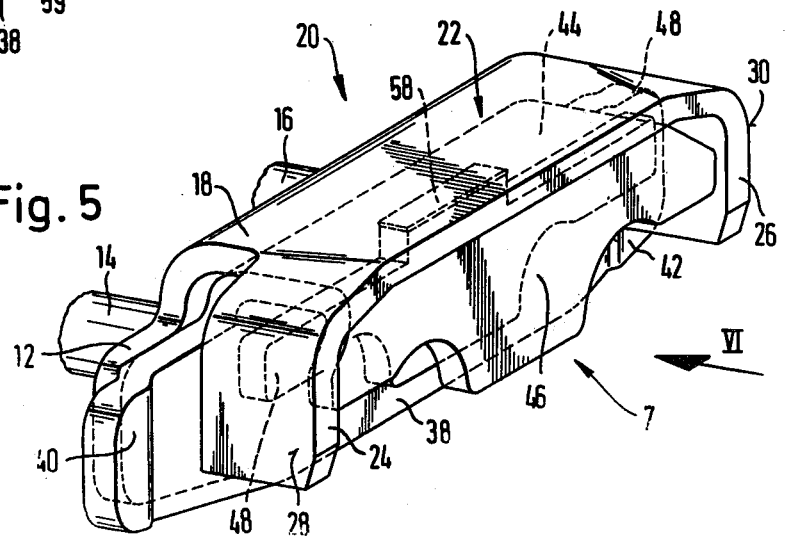
FIG. 5 illustrates a partial view of the carrier, striking member and support member riveted to the chain pins of a chain conveyor in accordance with the invention.
Figure 6:
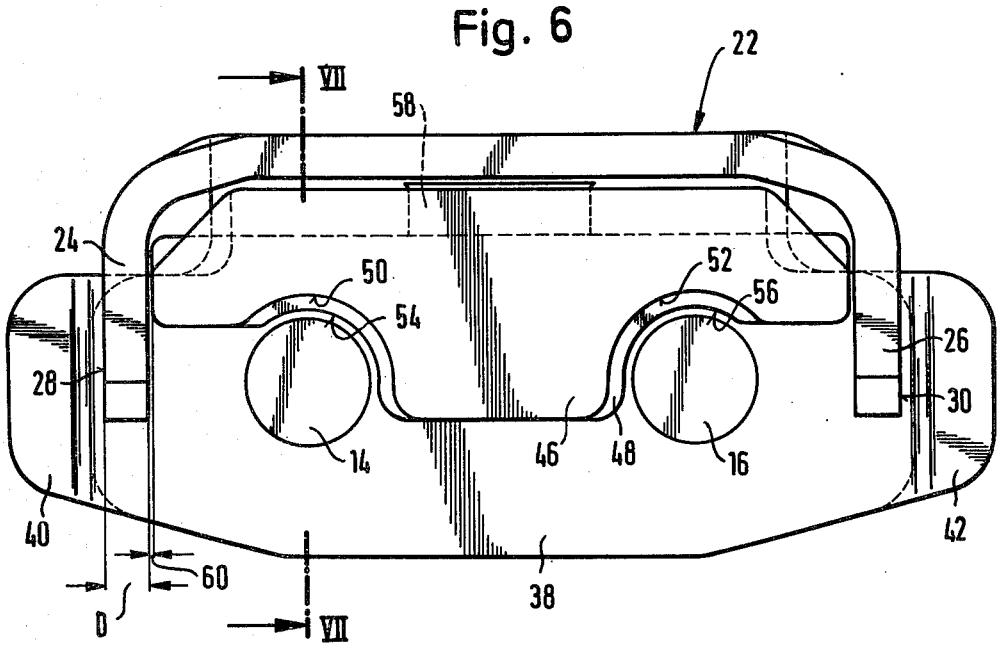
FIG. 6 illustrates a view taken in the direction of arrow VI of FIG. 5.

Referring to FIGS. 5 and 6, when assembled, the support member 36 is mounted within the striking member 22. To this end, the web 38 is disposed in parallel adjoining relation to the plate 12 of the carrier 20. In addition, the parallel ribs 46, 48 are in alignment with the striking plates 26, 28 and the ribs 46, 48 are spaced from the striking plates 26, 28 to define gaps 60. Where the striking plates 26, 28 are made of sheet metal, and are of a thickness D of, for example 1.6 millimeters, the width d of the gaps 60 can be, for example from 0.10 millimeters to 0.20 millimeters.

When the entraining elements 7 are in the unloaded condition the forwardmost striking plate 28 is spaced from the ribs 46, 48 of the support member 36. However, when a gripper shuttle 1 is struck, the forewardmost striking plate 28 resiliently deflects and abuts against the ribs 46, 48 of the support member 36.

Figure 7:
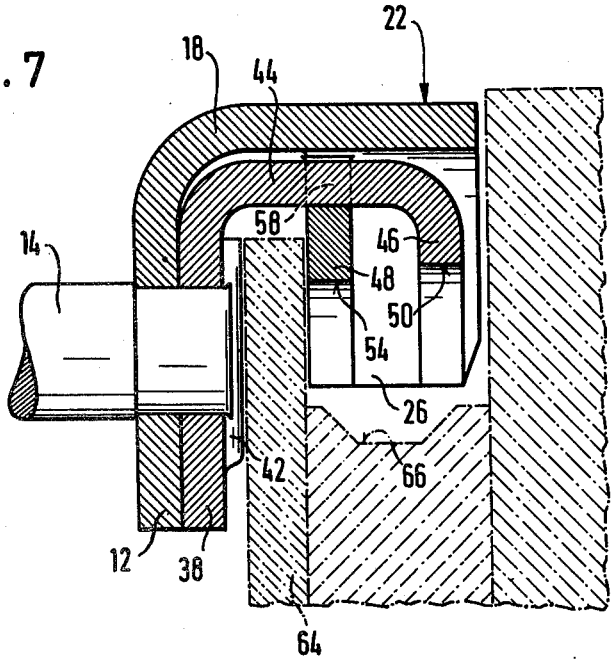
FIG. 7 illustrates a view taken on line VII — VII of FIG. 6.

As shown in FIG. 7, the innermost rib 48 forms a second guide surface for the guide wall 64 opposite to the projections 40, 42 of the web 38. Thus, the entraining element 7 can be readily guided along the guide channel 66 for the return of the shuttles 1.

The invention thus provides an entraining element which can be easily mounted on a conveyor chain in a fixed manner via the chain pins 14, 16 of the chain. Further, the entraining elements may be made of any suitable materials and, in particular, sheet metal to resist the stresses imposed on the elements. Thus, the operating life of the entraining elements can be relatively long. Further, since the striking plates are of a resilient nature and are spaced from the relatively rigid support member, the stresses imposed during striking of a projectile can be readily absorbed.

What is claimed is:

1. An entraining element for a gripper shuttle weaving machine, said element comprising
   - a carrier for mounting on a conveyor chain;
   - a striking member mounted on said carrier, said striking member including a resilient striking plate having a striking surface extending transversely to a gripper shuttle path; and
   - a support member mounted within said striking member in spaced relation behind said striking plate to define a gap therebetween.

2. An entraining element as set forth in claim 1 wherein said support member has a pair of parallel ribs extending longitudinally of said support member in alignment with said striking plate.

3. An entraining element as set forth in claim 1 wherein said support member is fixedly secured relative to said carrier.

4. An entraining element as set forth in claim 1 wherein said gap is of a width of from 0.10 millimeters to 0.20 millimeters.

5. An entraining element as set forth in claim 1 wherein said striking plate is made of sheet metal with a thickness of 1.6 millimeters.

6. An entraining element as set forth in claim 1 wherein said carrier includes a pair of sheet metal plates, one of said plates being integrally formed with said striking member.

7. An entraining element comprising
   - a carrier having a first plate;
   - a striking member extending from said first plate having a resilient striking plate extending transversely from said member and said first plate; and
   - a support member mounted within said striking member, said support member having a web extending parallel to said first plate and at least one longitudinally extending rib disposed in spaced alignment with said striking plate to define a gap therebetween whereby upon deflection, said striking plate resiliently abuts said rib.

8. An entraining element as set forth in claim 7 wherein said striking plate is made of sheet metal.

9. An entraining element as set forth in claim 8 wherein said gap is of a width of from 0.10 millimeters to 0.20 millimeters.

10. In a gripper shuttle weaving machine, the combination of
   - a conveyor chain disposed alongside a return path of a gripper shuttle; and
   - an entraining element mounted on said chain for returning a gripper shuttle in said path, said element comprising a carrier secured to said chain a striking member extending from said carrier and having a resilient striking plate extending transversely of said return path, said plate having a striking surface at a forward side thereof relative to said path to propel a gripper shuttle through said path, and a support member mounted on said carrier in spaced relation behind said striking plate to define a gap therebetween whereby, upon deflection, said striking plate resiliently abuts said support member.

11. The combination as set forth in claim 10 wherein said support member has a pair of parallel ribs extending longitudinally of said support member in alignment with said striking plate.

12. The combination as set forth in claim 11 wherein one of said ribs defines a guide path for a guide band.

13. The combination as set forth in claim 10 wherein said conveyor chain includes chain pins, said chain pins securing said carrier and said support member to said chain.

* * * * *